US005446633A

United States Patent [19]

Hanggi

[11] Patent Number: 5,446,633

[45] Date of Patent: Aug. 29, 1995

[54] WRITING IMPLEMENT WITH RECHARGEABLE BUILT-IN ILLUMINATION

[76] Inventor: Rolf Hanggi, 5121 Amberwood Cir., Suisun City, Calif. 94585

[21] Appl. No.: 162,612

[22] Filed: Dec. 7, 1993

[51] Int. Cl.[6] ..... B43K 29/10

[52] U.S. Cl. ..... 362/118; 362/183; 362/190; 320/2; 401/195

[58] Field of Search ..... 320/2; 362/109, 118, 362/183, 253, 190, 191, 202, 208; 401/195

[56] References Cited

U.S. PATENT DOCUMENTS

| | | | |
|---|---|---|---|
| 1,280,374 | 10/1918 | Bennett | 362/118 |
| 1,577,754 | 3/1926 | Rauch | 362/118 |
| 2,982,849 | 5/1961 | Volkerling et al. | 362/183 |
| 3,643,083 | 2/1972 | Heine | 362/183 |
| 4,016,414 | 4/1977 | Browning et al. | 240/6.46 |
| 4,028,540 | 6/1977 | Keys Jr. et al. | 362/118 |
| 4,134,056 | 1/1979 | Fukui et al. | 320/20 |
| 4,168,521 | 9/1979 | Bajusz et al. | 362/118 |
| 4,302,714 | 11/1981 | Yefsky | 320/5 |
| 4,354,148 | 10/1982 | Tada et al. | 320/20 |
| 4,518,274 | 5/1985 | Hanggi | 401/195 |
| 4,577,144 | 3/1986 | Hodgman et al. | 320/2 |
| 4,677,363 | 6/1987 | Kopmann | 320/44 |
| 4,890,204 | 12/1989 | Lin et al. | 362/118 |
| 4,964,024 | 10/1990 | Tsay | 362/118 |
| 4,991,069 | 2/1991 | Tiller | 362/183 |
| 5,131,775 | 7/1992 | Chen | 401/195 |
| 5,143,465 | 9/1992 | Hou | 401/195 |

*Primary Examiner*—Ira S. Lazarus

*Assistant Examiner*—Alan B. Cariaso

*Attorney, Agent, or Firm*—Allston L. Jones

[57] ABSTRACT

The present invention includes a combination of various designs for a writing implement with an illumination source and a rechargeable battery, and various designs for a docking station/battery charger combination for those writing implements to recharge the battery within the writing implement when the writing implement is in the docking station. The battery charger system of the present invention can be any of a variety of battery chargers that are currently available and can utilize many of the features that are available in such battery charger designs. A variety of battery chargers are available and any of them could be used with the various embodiments of the writing implements of the present invention. The simplest charger is one that is manually activated by the user when it is noticed that the light from the writing implement is growing dim. Another might be a charger that monitors the voltage level of the rechargeable battery and initiates a charging cycle when that voltage drops below a pre-set threshold. The charger could also be a so called 'smart charger' which can determine when the battery in the writing implement is not rechargeable and therefore not attempt to charge it. Such a 'smart charger' could also have the ability to automatically discharge and recharge the battery at a preselected interval, say every 60 days, to obtain the maximum life if it is a NiCad rechargeable battery, or to be able to distinguish between alkaline and NiCad batteries and to recharge them accordingly.

16 Claims, 7 Drawing Sheets

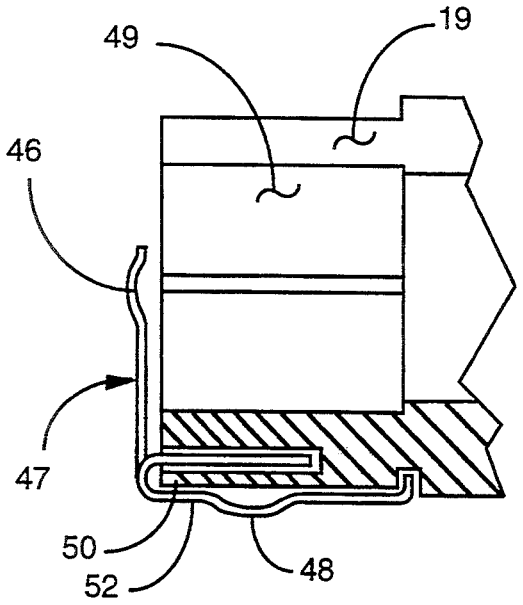
Fig. 4a
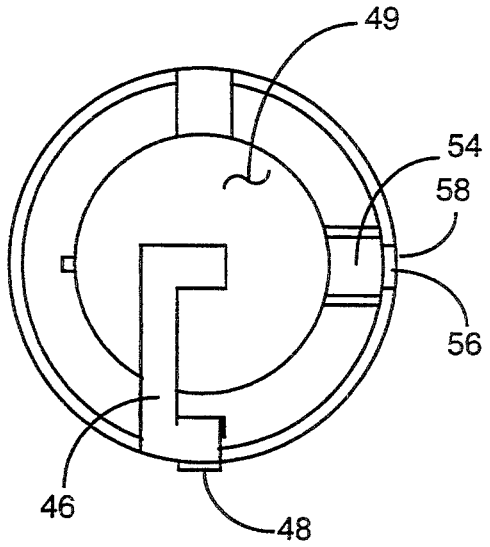
Fig. 4b
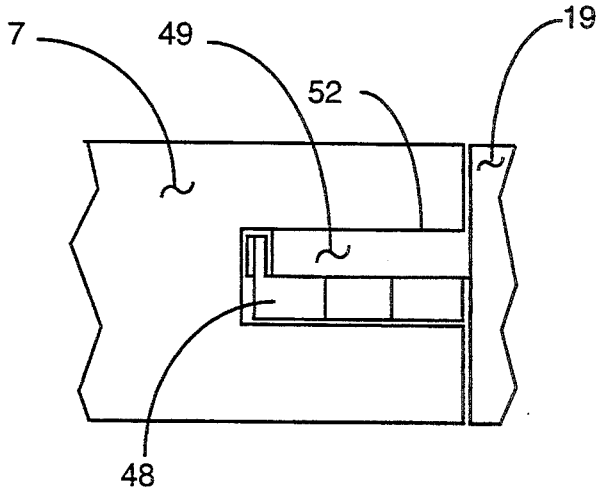
Fg. 4c

WRITING IMPLEMENT WITH RECHARGEABLE BUILT-IN ILLUMINATION

RELATED PATENT BY PRESENT INVENTOR

The inventor of the present invention holds U.S. Pat. No. 4,518,274, issued May 21, 1985, entitled "PEN WITH BUILT-IN ILLUMINATION".

FIELD OF THE INVENTION

The present invention relates to writing implements having self-contained illumination, more particularly, such writing implements that contain rechargeable batteries that further include automatic charging systems for said writing implements.

BACKGROUND OF THE INVENTION

In many situations there is a need to be able to write in a dark or low light environment without turning on, or the ability to turn on, a light. To meet that need many lighted writing implements have been described in numerous patents and are otherwise available. The short coming of each of the previous devices is that the batteries are not rechargeable, or if they are they do not automatically recharge when the writing implement is not in use. Thus, those devices, while the lighted feature is a desirable one, have not caught on for several reasons, not the least of which is that the batteries always seem to be dead when you need them the most.

It would be advantageous to have a lighted writing implement with a rechargeable battery and a companion charging system that leaves little to the user to do to initiate the recharging process. The more automatic the better. The present invention provides such a writing implement and charging system.

SUMMARY OF THE INVENTION

The present invention includes a combination of various designs for a writing implement with an illumination source and a rechargeable battery, and various designs for a docking station/battery charger combination for those writing implements to recharge the battery within the writing implement when the writing implement is in the docking station. The battery charger system of the present invention can be any of a variety of battery chargers that are currently available and can utilize many of the features that are available in such battery charger designs as discussed below.

A variety of battery chargers are available and any of them could be used with the various embodiments of the present invention. The simplest charger is one that is manually activated by the user when it is noticed that the light from the writing implement is growing dim. Another might be a charger that monitors the voltage level of the rechargeable battery and initiates a charging cycle when that voltage drops below a pre-set threshold. The charger could also be a so called 'smart charger' which can determine when the battery in the writing implement is not rechargeable and therefore not attempt to charge it. Such a 'smart charger' could also have the ability to automatically discharge and recharge the battery at a preselected interval, say every 60 days, to obtain the maximum life if it is a NiCad rechargeable battery, or to be able to distinguish between alkaline and NiCad batteries and to recharge them accordingly.

BRIEF DESCRIPTION OF THE DRAWINGS

FIGS. 4*a–d* are various partial views of the interconnection of the proximate-distal ends of the writing implement of FIG. 1 having the modified contact structure of FIGS. 2 and 3.

DETAILED DESCRIPTION OF THE PRESENT INVENTION

As will become clear, in the descriptions of the various embodiments of the present invention that follow, that the various embodiments of the two elements of the present invention can be interchanged with each other in most instances.

Figure 1A:
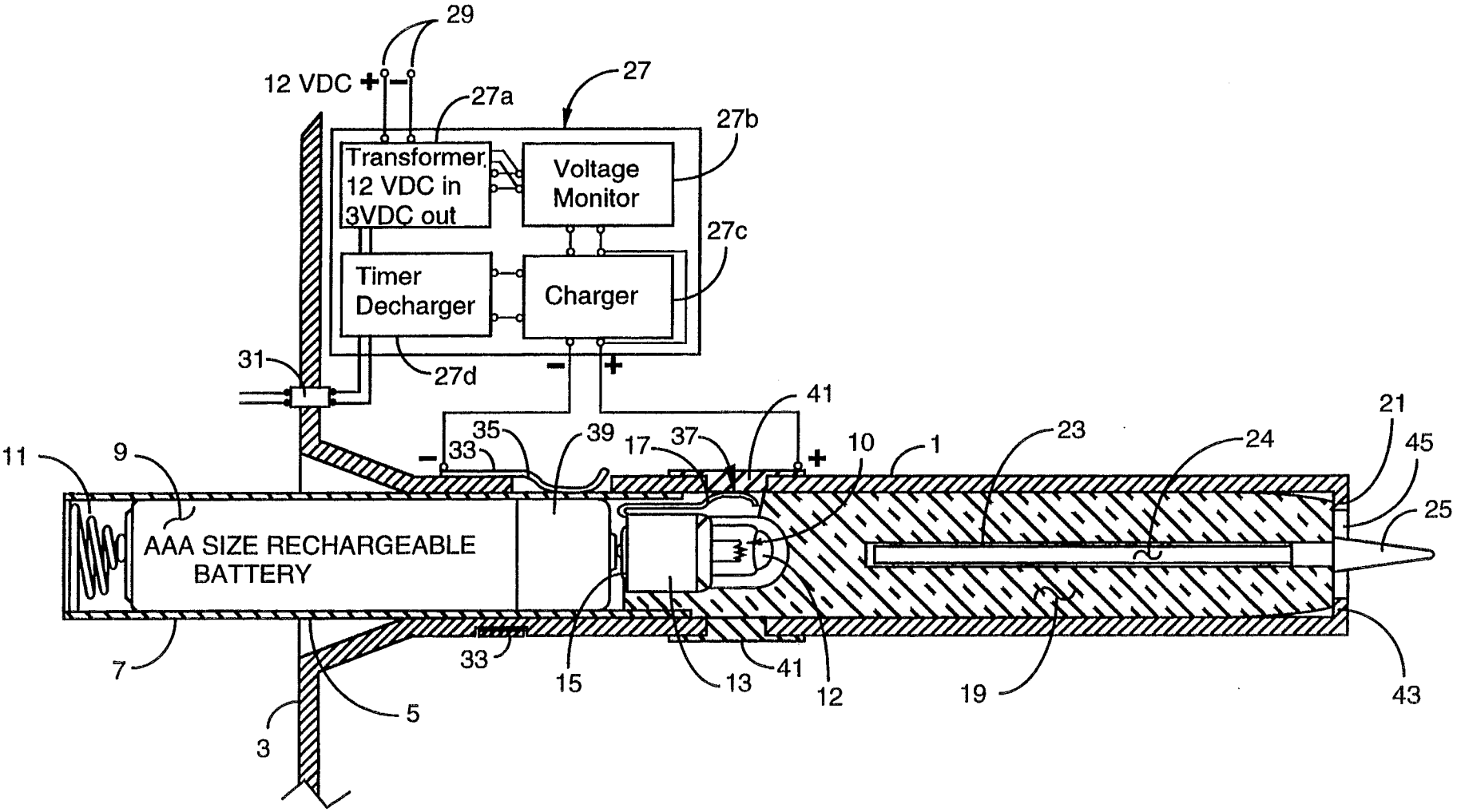
FIG. 1*a* is a cross-sectional view of one embodiment of the present invention writing implement and the corresponding docking station/charger therefor.
Figure 1B:
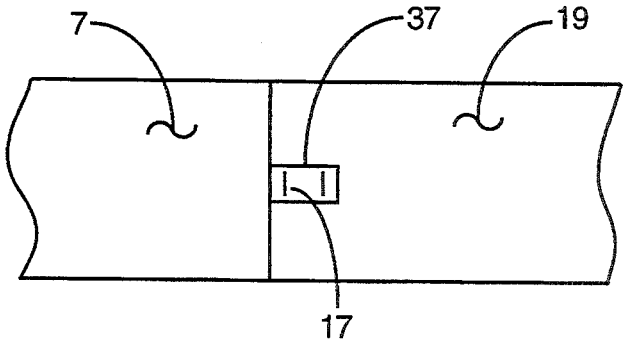
FIG. 1*b* is a partial assembled side view of the first embodiment writing implement.
Figure 1C:
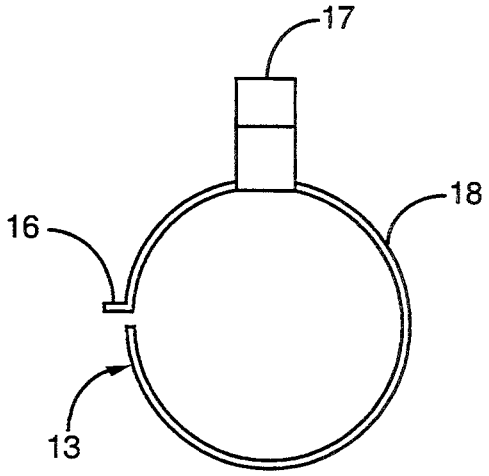
FIG. 1*c* is a longitudinal view of the socket ring of the first embodiment writing implement.

FIG. 1*a* illustrates an application for the present invention wherein the position of docking station 1 is fixed and extends behind a fixed panel 3 (e.g. the dashboard of a vehicle) where the user does not have easy access. It should be understood, however, that the actual interfacing features between docking station 1 and writing implement 5 shown in FIG. 1 could also be utilized in a portable application as discussed below in relation to FIG. 5*a*. The construction details of writing implement 5 determine the configuration of the corresponding interface elements of docking station 1.

In FIG. 1*a* docking station 1 is shown as being a integral part of panel 3, however, this is not necessary for the operation of this embodiment of the docking station of the present invention. Docking station 1 can alternatively be designed to be insertable in an opening in panel 3 and fastened thereto by any convenient method.

Also shown in FIG. 1*a* is the first embodiment of writing implement 5 which is shown within docking station 1, each in longitudinal cross-section to illustrate the cooperation between the components of one with the other. Here it can be seen that docking station 1 is nearly as deep as writing implement 5 is long to permit a portion of the proximate end of writing implement 5 to extend out from the face of panel 3 to permit easy removable of writing implement 5 for use. However, it is not necessary to the present invention that that length relationship be true.

Other storage, and extraction mechanisms and techniques could alternatively be utilized. For example, there could be a compression spring at the distal end of docking station 1 and a clip mechanism (not shown) at panel 3 that interfaces with the proximate end of writing implement 5 to hold it within docking station 1 in opposition to the outward biasing force of the distal spring. Thus, when the clip is released the distal spring expands and pushes writing implement 5 at least partially out of docking station 1 so that the proximate end of writing implement 5 can be grasped by the user.

Shown here, the outer outline of writing implement 5 is defined by a cylindrical top, or proximate end, portion 7 and a substantially cylindrical light propagating portion 19 with portion 19 tapering slightly near the distal end where writing tip 25 is located (with that tapering not being necessary for the operation of the present invention however, it makes the writing point more visible when the user is writing). Portions 7 and 19 are connected to each other by any convenient technique (e.g. a threaded interface, friction fit, an interconnection ring, etc.). Within the two outlines defining portions 7 and 19, the interior components of writing implement 5 are substantially in coaxial alinement with each other.

Top portion 7 is shown defining an-interior cavity that is substantially a longitudinal cylinder (or any convenient longitudinal shape that in the smallest cross-longitudinal direction is at least as large as the diameter of internal battery 9) that has a blind end at the proximate end of writing implement 5. Within the cylindrical top portion 7 there is a battery pressure spring 11 in communication between the blind interior end of top portion 7 and the conductive bottom (negative terminal) of a battery 9, that is shown here as being a rechargeable battery. Thus spring 11 biases battery 9 axially toward the distal end of writing implement 5 to maintain the positive terminal of battery 9 in electrical contact with the center base terminal 15 of lamp 10 which is located at the open end of top portion 7 with transparent globe 12 of lamp 10 oriented toward, or extending out from, the distal open end of top portion 7.

Additionally, lamp 10 is mounted in electrically conductive socket 13 (see FIG. 1*c* also for details) that is made of an electrically conductive spring material so that each portion of socket 13 tends to return to its static shape. Socket 13 includes a ring 18 and a spring finger 7. Ring 18 has an inner diameter that is slightly smaller than the diameter of the outer circumferential surface of the conductive base 14 of a lamp 10 (here ring 18 is shown being flat, however, it could also define threads to interface with a lamp having a threaded base). Thus, when base 14 is inserted within ring 18, the spring nature and the smaller diameter causes ring 18 to engage base 14 and make electrical contact therewith. Similarly, when writing implement 1 is removed from docking station 1, spring finger 17 extends into first access port 37 through the side of writing implement 5 (see FIG. 1*b*), thus creating a conductive path from socket 13, when spring finger 17 comes into contact with the inner surface of top portion 7 (a wired connection or the conductive inner surface of top portion 7 if it is made of a conductive material), along the inner surface of top portion 7 to spring 11 and, in turn, to the negative terminal of battery 9 resulting in lamp 10 being illuminated. Conversely, when writing instrument 7 is inserted into docking station 1, the inner surface of docking station 1 depresses finger 17 inward thus breaking the connection to the negative terminal of battery 9 resulting in lamp 10 being extinguished. Additionally, an optional positioning tab 16, disposed to mate with an internal groove in the distal end of top portion 7, is shown extending outward from ring 18 to prevent the rotation of socket 13 with writing implement 5.

Aligned axially with transparent globe 12 of bulb 10, is the shaped light propagation portion 19 to propagate light from bulb 10 to the distal end 21 of itself. As shown here, though not a limitation on the present invention, light propagating portion 19 has a shaped cavity in the proximate end thereof to at least receive the top most portion of globe 12. Propagation portion 19 is also shown defining an axially located cavity 23 that extends thereinto from distal end 21 thereof to receive and retain the upper portion 24 of a writing instrument mechanism (e.g. a ball point pen, felt tipped marker, mechanical pencil, etc.) with writing tip 25 extending beyond distal end 21 of propagation portion 19. With upper portion 24 of the writing instrument mechanism axially centered within propagation portion 19 and tip 25 extending beyond distal end 21 thereof, light will illuminate the point of contact of writing tip 25 and make that spot visible even in complete darkness.

Additionally, approximately mid-way between the proximate and distal ends of writing instrument 5, at the point of interface between top portion 5 and propagation portion 19, propagation portion 19 defines a first access port 37 to the outside surface of writing implement 5. First access port 37, as described above, is provided to accommodate formed spring finger 17 of socket 13 that is biased to extend into access port 37 when writing instrument 5 is not contained within docking station 1. When finger 17 is allowed to extend into first access port 37, socket 13 is connected electrically with the electrical path to the negative terminal of battery 9 discussed above. This then serves as an automatic switch to complete the electrical path between the two ends of battery 9 with lamp 10, thus causing lamp 10 to illuminate.

As discussed above, docking station 1 is shaped and sized to receive light propagating portion 19 and substantially the entire length of cylindrical top portion 7. In FIG. 1 the depth to which writing implement 5 can be inserted is limited by distal end 21 bottoming at the distal end 43 of docking station 1 with writing tip 25 passing through a central hole 45 defined thereby. By permitting writing tip 25 not to bottom out against another surface will minimize the tendency for writing tip 25 to become clogged, particularly when the writing implement mechanism is a ball point pen.

Referring again to FIG. 1 it can be seen that when writing implement 5 is inserted into docking station 1, finger 17 is depressed by the inner surface of docking station 1. Also, when writing implement 5 is fully inserted into docking station 1, finger 17 makes electrical contact with a positive charger terminal ring 41 that extends through the side wall of docking station 1 at the corresponding depth of finger 17 when writing implement 5 is fully inserted. Here positive charger terminal ring 41 is shown encircling docking station 1 and extending into the interior thereof flush with the overall interior surface of docking station 1 so that terminal 17 comes into contact therewith without writing implement 5 having to have a particular orientation. Also, given this construction, terminal ring 41 divides docking station 1 into two parts and the outer portion of terminal ring 41 is shown overlapping both portions of docking station 1 to retain them together as a continuous cylinder by any convenient joining technique (e.g. threads, friction fit, glue, etc.).

Of course, if portions 7 and/or 19 of writing implement 5 and the interior of docking station 1 are keyed to permit the insertion of writing implement 5 thereinto in only one orientation, positive charger terminal ring 41 could be replaced with a single contact that extends through the side wall of docking station 1 at the particular location where it will mate with finger 7 when writing implement 5 is inserted into docking station 1.

The negative charger terminal 35, an integral part of a ring 33 that encircles more than ½ the circumference of docking station 1, is shown as a spring finger that extends through a second access port 39 through the side wall of docking station 1 at a single location. This is possible if cylindrical top portion 7 of writing implement 5 is electrically conductive, or has a conductive ring therearound at the location that is opposite terminal 35 and that is electrically connected with spring 11 by some means.

Thus, when writing implement 5 is inserted into docking station 1 and the appropriate portions thereof are in contact with terminals 35 and 41, the electrical circuit between battery charger 27 and battery 9 is complete. In this configuration, that circuit is from the negative terminal of battery charger 27 to finger 35 in contact with the conductive outer portion of cylindrical top portion 7, then to spring 11 and the negative terminal of battery 9. Similarly, the positive terminal of battery charger 27 is connected to terminal 41 which in turn contacts finger 17 (being separated from the inner surface of top portion 7) which is a part of socket 13 via which charging current is applied to the positive terminal of battery 9 through the filament and center base terminal 15 of lamp 10. The actual recharging process is discussed below following further discussion of the other elements of the present invention.

Alternatively, if the orientation of writing instrument 5 and docking station 1 are keyed to each other or if terminal 35 is also a ring that encircles docking station 1, then cylindrical top portion 7 of writing implement 5 only needs to have a single conductive spot that is electrically connected to spring 11 without cylindrical top portion 7 having to otherwise be conductive to the outside thereof.

Referring now to panel 3 there is shown a battery charger 27 mounted behind panel 3. Further, battery charger 27 is shown (terminals 29) as being powered from the 12 VDC system of the automobile, or in other applications, whatever power source is convenient. Also shown extending through panel 3 is one or more optional small light emitting devices 31, such as a miniature bulb or LED. Small light emitting devices 31 could be provided as indicators of several different things, for example one can be provided in close proximity to the opening into docking station 1 to mark that location in the dark so that the user can find and return writing implement 5 to docking station 1 with light emitting device 31 being illuminated only when the dashboard lights of the vehicle are on, or perhaps when that condition is met and writing implement 5 has been removed from docking station 1. Additionally, a light emitting device 31 may be provided that blinks when battery 9 is being charged and is extinguished when the charging operation is completed.

As mentioned above, battery charger 27 could be very simple in that the user must turn it on and off, to one of a 'smart charger' design that are becoming more popular. Here, battery charger 27 is shown of the 'smart' type which includes transformer **27*a*, which is necessary in all types of chargers, a voltage monitor 27*b* to permit charger to occur only when the battery voltage is below a preset level, a timer discharger to discharge battery 9 at preset intervals, and the charger unit 27*c* that controls the rate at which charging current is applied to battery 9 and which can also include the means for determining whether battery 9** is alkaline, NiCad or non-rechargeable.

Figure 2:
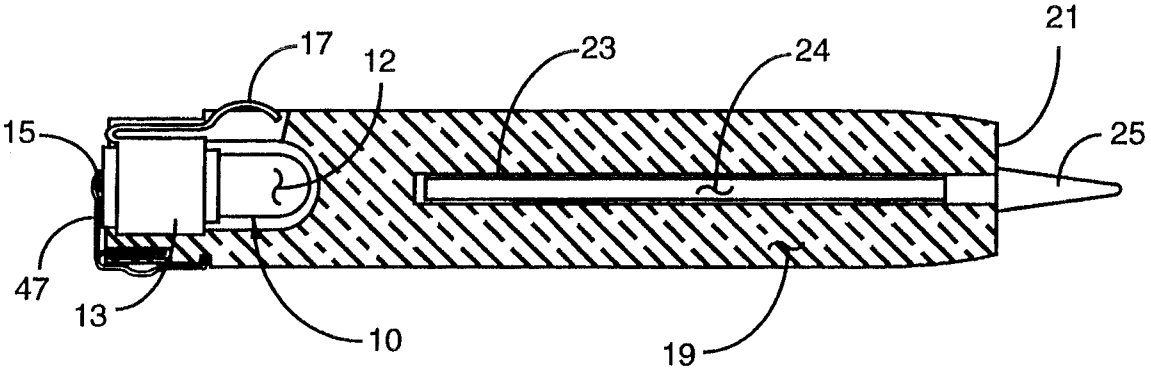
FIG. 2 is a cross-sectional view of one design for the distal half of the writing implement of FIG. 1 with a modified contact structure with the lamp.
Figure 3:
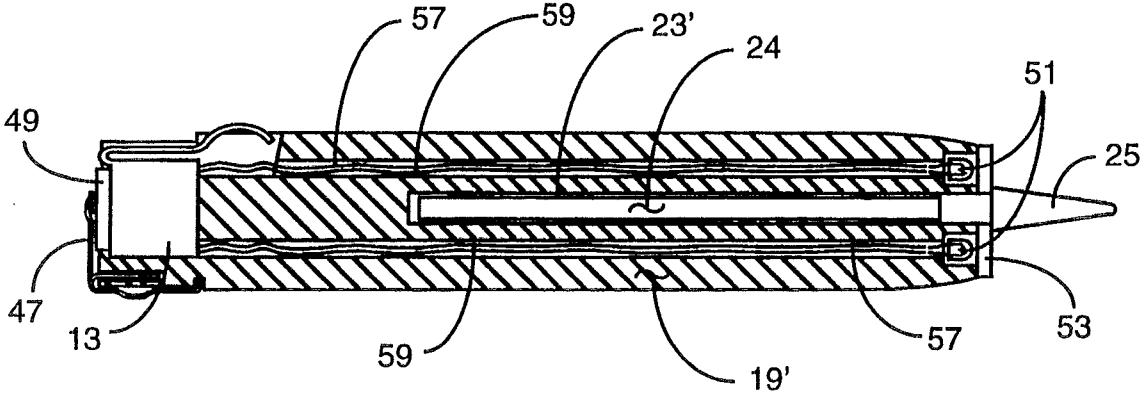
FIG. 3 is a cross-sectional view of a second design for the distal half of the writing implement of FIG. 1 with multiple light emitting devices and the modified contact structure as in FIG. 2.

FIG. 2 has been included to show two things and to make its comparison with the variation in design shown in FIG. 3 easier. In detail, FIG. 2 shows the details of distal end 19 as discussed above in cooperation with lamp 10 in socket 13. In addition, so that the charging current does not have to flow through the filament of lamp 10, as discussed above, or in applications such as that in FIG. 3 where lamp 10 is not used, a conductive, substantially 'L' shaped bracket 47 is included with one leg of the 'L' in contact with base terminal 15 of lamp 10 and the other leg of the 'L' exposed to the outer surface of top portion 7 as will be seen by referring to FIGS. **4*a–c* and the charging operation by referring to FIG. 5*a***.

Referring next to FIG. 3, an alternative to light propagating portion 19 of FIG. 1 is shown with the necessary supporting elements. Alternative distal portion 19' can be made of any material since in this configuration light is not being propagated from its proximate end to its distal end Instead portion 19' in addition to defining central cavity 23' for receiving the top portion 24 of the writing implement mechanism, it defines passages 57 along the entire length of portion 19' in each of which a pair of wires 59 extend from the terminals at the proximate end of portion 19' to individual light emitting devices 51 just inside disk 53, through which light can pass, opposite writing tip 25. In this design, socket 13 with finger 17 is shown with ring 18 encircling a cylindrical, non-conductive spacer 49, and 'L' shaped bracket 47 to provide the electrical contacts to permit the charging of battery 9.

In FIG. 3 two light emitting devices 51 are shown at the distal end of portion 19' however as many or as few of devices 51 as desired and which will fit in that position may be used. For even lighting of the point of contact of writing tip 25, at least three light emitting devices 51 are necessary to minimize shadows.

Figure 4D:
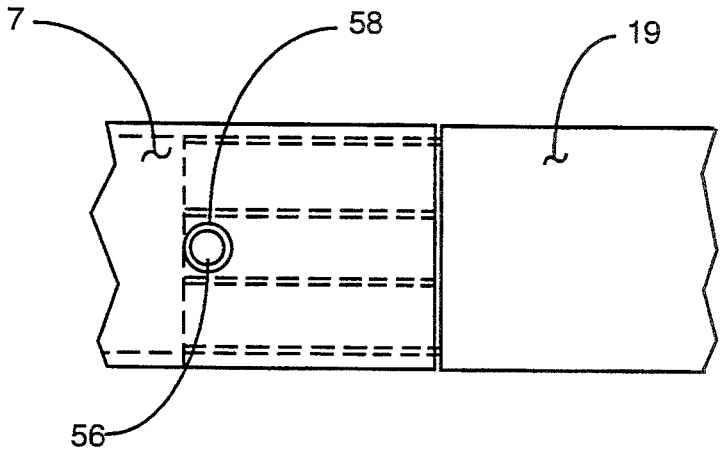

FIGS. **4*a–d* illustrate both the mounting of 'L' shaped bracket 47 and another mechanism for attaching top portion 7 to distal portion 19. FIG. 4*a* shows a longitudinal cross-section of the proximate end of distal portion 19 with non-conductive spacer 49 therewithin, and 'L' shape bracket 47 is greater detail. FIG. 4*b* shows the proximate end view of distal portion 19 with 'L' shaped bracket 47 in place, and FIG. 4*c* shows the juncture of top portion 7 and with distal portion 19 with to outward oriented finger 48 of 'L' shaped bracket 47 extending through side port 52 of top portion 7. More specifically, 'L' shaped bracket 47 has three sections, positive battery contact leg 46, outward oriented finger, or leg, 48, and a rotation prevention finger 50 that extends into cavity 52 in the proximate end of distal portion 19. The battery charging operation with this arrangement is discussed below with respect to FIG. 5*a***.

FIGS. **4*b* and 4*d* also illustrate one technique for interconnecting the top and distal portions 7 and 19, respectively, of writing implement 5. Shown is a cylinder 54 with a captive spring-loaded push-button 56 is shown in a cavity defined in the proximate end of distal portion 19 extending outward from non-conductive spacer 49, with push-button 56 extending through a hole 58 that is defined through the distal end of top portion 7 to releasably interlock the top and distal portions of writing implement 5**.

Figure 5B:
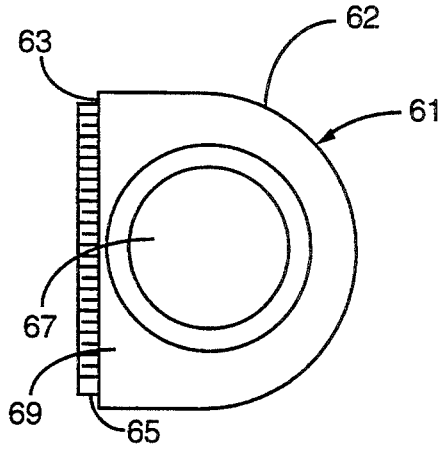
FIG. 5*b* is a view of the open end for receiving the writing implement of the docking station/charger of FIG. 5.
Figure 5A:
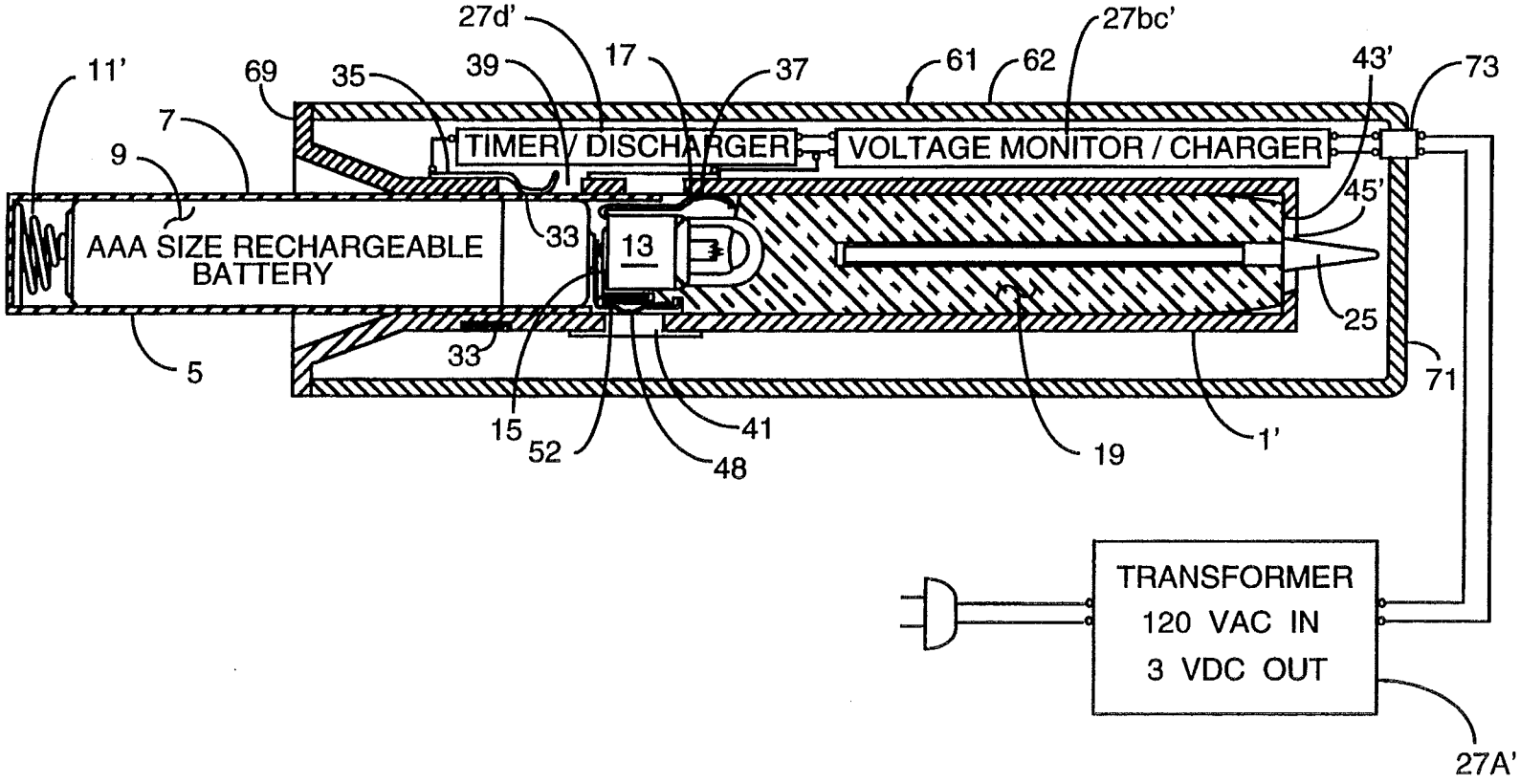
FIG. 5*a* is a cross-sectional view of a second embodiment of the present invention writing implement stored in a second design for the docking station/charger therefor.

FIG. 5*a* illustrates a docking station 61 that is fully self-contained and semi-portable, or a self contained unit (e.g. a desk top pen and pencil set). Writing implement 5 shown here is substantially the same as that discussed with respect to FIG. 1*a* with three differences. Coil spring 11 has been replaced with a leaf spring 11' to bias battery 9 toward lamp 10, 'L' bracket 47 has been included with outwardly oriented finger 48 being exposed through port 52, and spring finger 17 and port 37 is located forward of positive charger terminal ring 41 when writing implement 5 is inserted to the full extent with docking station 61.

Docking station 61, as shown here and in FIG. 5*b*, includes an inner sleeve 1' and an outer housing 62. Inner sleeve 1' is substantially the same as housing 1 of FIG. 1*a* defining an interior cavity 67, and outer housing 62 totally encloses inner sleeve 1' and defines interior space therebetween with proximate and distal ends 69 and 71, respectively. Within that included space several of the component sections of battery charger 27 of FIG. 1*a* are shown, namely timer/discharger 27*d'* and a combination of voltage monitor and charger 27*bc'*. The transformer 27*a'* portion of the charger is shown here external to docking station 61 and interfaces with the interior portions of the charger via connector 73.

This style docking station provides a great many additional options in that outer housing 62 can be take on any desired shape. FIG. 5*b* shows outer housing 62 being substantially half-round with a flat side 63 which can be mounted on a flat surface such as a wall, clipboard, etc., with double-sided tape, Velcro (TM), or another mounting system. With transformer 27*a'* being detachable, docking station 61 can be totally portable when in use and returned to a convenient location for connection to transformer 27*a'* when not in use.

Figure 5C:
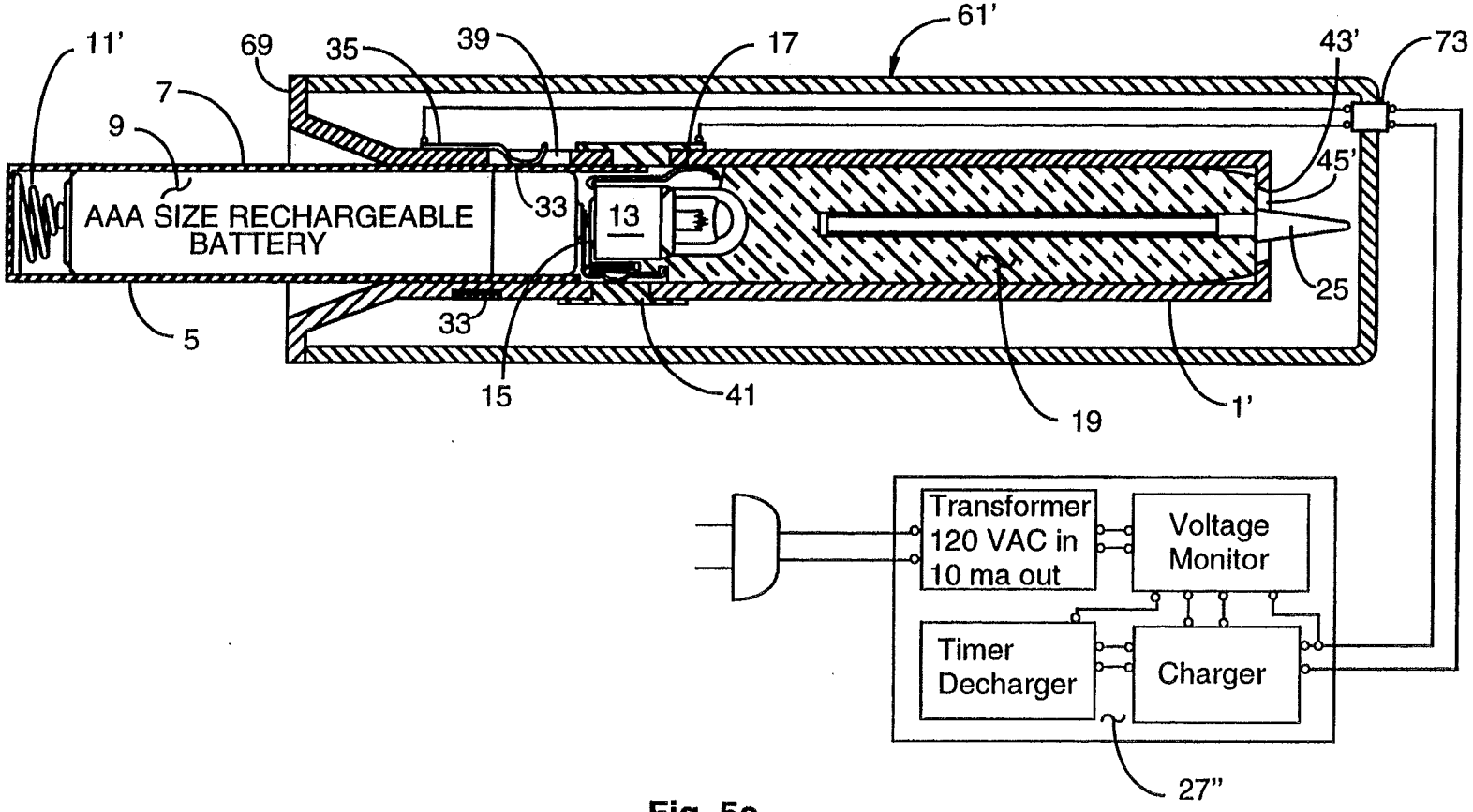
FIG. 5*c* is a modified form of the second embodiment of that shown in FIG. 5 with the battery charger mounted external to the docking station for the writing implement.

The configuration of the present invention shown in FIG. 5*c* is similar to that of FIG. 5*a* with all of the components of battery charger 27'' being external to docking station 61'. In this figure, battery charger 27'' is shown being connectable to housing station 61' via connector 73.

While there has been shown and described various preferred embodiments of the present invention, it will be apparent to those skilled in the art that many modification may be made without departing from the present invention in its broadest aspects. Therefore, the appended claims are intended to cover all such modification and changes that fall within the true spirit and scope of the invention.

What is claimed is:

1. A writing implement for writing on a surface having a built-in illumination system defining a space for inclusion of a battery having a first and a second terminal being of opposite electrical polarity from each other, said writing implement comprising:

a top portion to house said battery in axial alignment therewithin, said top portion having a blind proximate end and an open distal end with at least a portion of the interior of said top portion being electrically coupleable to said first terminal of said battery to provide an electrically conductive path therefrom to said open end, and with closure means defined at said open end;

a bottom portion of a non electrically conductive material having a proximate end and a distal end with said proximate end defining a means for mating with said closure means of said top portion to interconnect said top and bottom portions, said bottom portion defining an opening at said distal end thereof;

wherein at least one of said top portion at the distal end thereof and said bottom portion at the proximate end thereof defines a first side opening port therethrough;

a writing implement mechanism having a writing tip with said mechanism being housed within said bottom portion with said writing tip passing out therefrom through said opening defined at the distal end of said bottom portion;

an illumination system within at least one of said top and bottom portions having a third and a fourth electrical terminal with said third electrical terminal coupleable to said second terminal of said battery to illuminate the surface upon which said writing tip comes into contact while being used; and an electrically conductive spring finger coupled to said fourth electrical terminal of said illumination system and biased to extend into said first side opening port to make electrical contact with said electrically conductive path of said top portion to complete the electrical circuit between said third and fourth electrical contacts of said illumination system and said first and second contacts of said battery, and to break said electrical circuit when said spring finger is depressed into said first side opening port.

2. A system including a writing implement for writing on a surface having a built-in illumination source defining a space for inclusion of a battery having a first and a second terminal being of opposite electrical polarity from each other and a housing in which to store said writing implement when not in use, said system comprising:

a writing implement having:

a top portion to house said battery in axial alignment therewithin, said top portion having a blind proximate end and an open distal end with at least a portion of the interior of said top portion being electrically coupleable to said first terminal of said battery to provide an electrically conductive path therefrom to said open end, and with closure means defined at said open end;

a bottom portion of a non electrically conductive material having a proximate end and a distal end with said proximate end defining a means for mating with said closure means of said top portion to interconnect said top and bottom portions, said bottom portion defining an opening at said distal end thereof;

wherein at least one of said top portion at the distal end thereof and said bottom portion at the proximate end thereof defines a first side opening port therethrough;

a writing implement mechanism having a writing tip with said mechanism being housed within said bottom portion with said writing tip passing out therefrom through said opening defined at the distal end of said bottom portion;

an illumination system within at least one of said top and bottom portions having a third and a fourth electrical terminal with said third electrical terminal coupleable to said second terminal of said battery to illuminate the surface upon which said writing tip comes into contact while being used; and an electrically conductive spring finger coupled to said fourth electrical terminal of said illumination system and biased to extend into said first side opening port to make electrical contact with said top portion to complete the electrical circuit between said third and fourth electrical contacts of said illumination system and said first and second contacts of said battery, and to break said electrical circuit when said spring finger is depressed into said first side opening port;

wherein said top portion provides external electrical access to said internal electrically conductive path; and a housing including:

a cavity defined therein that is sized and shaped to axially receive at least a portion of said top portion and external access to said spring finger of said writing implement and to depress said spring finger when said writing implement is inserted into said cavity;

a fifth electrically conductive terminal positioned to correspond with the position of and to mate with an external electrical access of said top portion to make electrical connection therewith and a sixth electrically conductive terminal to mate with said spring finger to electrically interconnect with said first and second terminals of said battery external to said top and bottom portions of said writing implement when said writing implement is inserted into said cavity of said housing; and a battery charger coupled to said fifth and sixth electrically conductive terminals.

3. A writing implement as in claim 1 wherein said top portion is constructed of an electrically conductive material thus said conductive path is said electrically conductive material of said top portion.

4. A writing implement as in claim 1 wherein:

at least one of said top portion at the distal end thereof and said bottom portion at the proximate end thereof defines a second side opening port therethrough displaced from said first port therethrough; and said illumination system includes:

a second electrically conductive finger coupled to said third electrical terminal of said illumination system and extending into said second side opening port.

5. A writing implement as in claim 1 wherein said illumination system includes:

a light transmissive port that occupies a portion of said opening in said distal end of said bottom portion with said light transmissive port being adjacent said writing tip of said writing implement; and a light emitting device internal to said bottom portion and positioned to provide a light beam to pass through said light transmissive port to illuminate the surface upon which said writing tip is to write while being used, said light emitting device having said third and a fourth electrical terminals.

6. A system as in claim 2 wherein said top portion of said writing implement is constructed of an electrically conductive material thus said conductive path is said electrically conductive material of said top portion and said conductive point is a point on the exterior of the conductive material of said top portion.

7. A system as in claim 2 wherein:

at least one of said top portion at the distal end thereof and said bottom portion at the proximate end thereof of said writing implement defines a second side opening port therethrough displaced from said first port therethrough; and said illumination system of said writing implement includes:

a second electrically conductive finger coupled to said third electrical terminal of said illumination system and extending into said second side opening port.

8. A system as in claim 2 wherein said illumination system of said writing implement includes:

a light transmissive port that occupies a portion of said opening in said distal end of said bottom portion with said light transmissive port being adjacent said writing tip of said writing implement; and a light emitting device internal to said bottom portion and positioned to provide a light beam to pass through said light transmissive port to illuminate the surface upon which said writing tip is to write while being used, said light emitting device having a third and a fourth electrical terminal.

9. A system as in claim 2 wherein said battery charger is a smart battery charger.

10. A system as in claim 9 wherein said smart battery charger includes means for determining when said included battery is a non-rechargeable battery and to not attempt to charge such a battery.

11. A system as in claim 10 wherein said smart battery charger includes means for automatically discharging and recharging said included battery at preselected intervals.

12. A writing implement as in claim 1 wherein said illumination system includes a high output LED.

13. A writing implement as in claim 1 wherein said illumination system includes a miniature lamp and diffuser internal to and at the distal end of said bottom portion.

14. A system as in claim 2 wherein said illumination system of said writing implement includes a high output LED.

15. A system as in claim 2 wherein said illumination system of said writing implement includes a miniature lamp and diffuser internal to and at the distal end of said bottom portion of said writing implement.

16. A writing implement as in claim 1 wherein said top portion provides external electrical access to said internal electrically conductive path to provide external battery charger access between said external electrical access and said spring finger, when said spring finger is depressed, to charge said battery which said writing implement is disposed to include.

* * * * *